US009275521B2

(12) United States Patent
Chang et al.

(10) Patent No.: US 9,275,521 B2
(45) **Date of Patent: *Mar. 1, 2016**

(54) METHOD OF ADAPTING A CLASS II GAME TO PROVIDE THE PLAY CHARACTERISTICS OF A CLASS III GAME

(71) Applicant: AGS, LLC, Las Vegas, NV (US)

(72) Inventors: Yi-Chen Chang, Mississauga (CA); Inna Lifchits, Maple (CA); Olaf Vancura, Henderson, NV (US)

(73) Assignee: AGS, LLC, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/860,145

(22) Filed: Apr. 10, 2013

(65) Prior Publication Data

US 2013/0303255 A1 Nov. 14, 2013

Related U.S. Application Data

(63) Continuation of application No. 13/238,990, filed on Sep. 21, 2011, now Pat. No. 8,439,742.

(51) Int. Cl.
*A63F 9/24* (2006.01)
*G07F 17/32* (2006.01)

(52) U.S. Cl.
CPC ..... *G07F 17/3286* (2013.01); *G07F 17/329* (2013.01); *G07F 17/3258* (2013.01); *G07F 17/3267* (2013.01)

(58) Field of Classification Search
CPC ..... G07F 17/32
USPC ..... 463/16
See application file for complete search history.

(56) References Cited

U.S. PATENT DOCUMENTS

2007/0155473 A1 7/2007 Powell et al.
2007/0161423 A1 * 7/2007 Bienvenue et al. ..... 463/19

* cited by examiner

*Primary Examiner* — Omkar Deodhar
(74) *Attorney, Agent, or Firm* — Holland & Hart LLP

(57) ABSTRACT

Methods, systems, and devices for adapting a Class II game to provide play characteristics of a Class III game are provided. Plays of the Class III game are simulated in a computer to obtain frequencies of occurrence of at least one Class III award. Plays of the Class II game are simulated in a computer to obtain frequencies of occurrence of at least one Class II outcome. A Class III award is selected. A Class II outcome having a similar frequency of occurrence to the selected Class III award is selected. An award is defined for the selected Class II outcome according to the selected Class III award.

1 Claim, 10 Drawing Sheets

METHOD OF ADAPTING A CLASS II GAME TO PROVIDE THE PLAY CHARACTERISTICS OF A CLASS III GAME

CROSS REFERENCE TO RELATED APPLICATION

This application is a continuation of U.S. patent application Ser. No. 13/238,990, filed Sep. 21, 2011, and entitled "Method of Adapting a Class II Game to Provide the Play Characteristics of a Class III Game," which is expressly incorporated herein by reference in its entirety.

BACKGROUND

Class III Games

A slot machine is a typical example of a Class III game. A player in such a game generally plays against the house. Each game is generally independent of previous games, and any outcome can occur in any game. An "outcome" is generally what the player sees when the game reaches a conclusion, and a "favorable outcome" is one that results in an award. For example, one possible favorable outcome in many slot machines is a row of three bells. There are countless possible symbol patterns that can result in favorable outcomes.

An "award" is generally what the player receives from a favorable outcome. Some Class III games give awards in the form of cash, whereas others may give credits that can be used in place of cash to place a wager in a subsequent game.

Class III slot machines generally fall into the following definition: (1) any so-called "slot machine" or any other machine or mechanical device an essential part of which is a drum or reel with insignia thereon, and (A) which when operated may deliver, as the result of the application of an element of chance, any money or property, or (B) by the operation of which a person may become entitled to receive, as the result of the application of an element of chance, any money or property; or (2) any other machine or mechanical device (including, but not limited to, roulette wheels and similar devices) designed and manufactured primarily for use in connection with gambling, and (A) which when operated may deliver, as the result of the application of an element of chance, any money or property, or (B) by the operation of which a person may become entitled to receive, as the result of the application of an element of chance, any money or property; or (3) any subassembly or essential part intended to be used in connection with any such machine or mechanical device, but which is not attached to any such machine or mechanical device as a constituent part (see, e.g., 15 U.S.C. 1171 (Johnson Act)).

Class II Games

In a Class II game a player competes with other players for a common award. Bingo is an example of a Class II game. Unlike a Class III game, which can, and often does, end without the player winning anything, a Class II game such as Bingo continues until there is a winner.

Bingo, a game of chance played with randomly drawn numbers, takes many forms in different countries. In the United States, Bingo is usually played using 5×5 matrices. The matrices may be printed on paper card stock or may be electronically presented. The usual Bingo game ends when one player wins by getting a specified pattern on his/her card. Commonly this pattern is a fill of all live elements in any row or column of the matrix.

Alternatives have been proposed to generate more interest and excitement. For example, instead of winning by filling the elements of one row or column, a win might be defined as filling the entire matrix, or the elements of a diagonal or some other pre-defined pattern. In some variations, an award is given for not filling any elements of a pre-defined pattern.

The term "class II gaming" generally means—(i) the game of chance commonly known as bingo (whether or not electronic, computer, or other technological aids are used in connection therewith)—(I) which is played for prizes, including monetary prizes, with cards bearing numbers or other designations, (II) in which the holder of the card covers such numbers or designations when objects, similarly numbered or designated, are drawn or electronically determined, and (III) in which the game is won by the first person covering a previously designated arrangement of numbers or designations on such cards, including (if played in the same location) pull-tabs, lotto, punch boards, tip jars, instant bingo, and other games similar to bingo (see, e.g., Indian Gaming Regulatory Act, 25 USC sec. 2703(7)).

Level of Excitement

It has been found that Class II games may have not been able to generate a level of interest and excitement comparable to Class III games with their great varieties of possible winning patterns and the like.

SUMMARY

Briefly and in general terms, the invention resides in a method of adapting a Class II game to provide the play characteristics, which may include math properties, play choreography, look, and/or feel, of a Class III game. This method may include simulating a plurality of plays of the Class III game in a computer to obtain frequencies of occurrence of at least one Class III award, simulating a plurality of plays of the Class II game in a computer to obtain frequencies of occurrence of at least one Class II outcome, selecting a Class III award, selecting a Class II outcome that has a similar frequency of occurrence to the selected Class III award, and defining an award for the selected Class II outcome according, to the selected Class III award.

Relative frequencies of main and special sequences that yield the selected Class III award may be obtained from the Class III simulation. Then, when the selected Class II outcome occurs during play of the Class II game, either a main or a special sequence that yields the selected Class III award is chosen by random selection. The player is presented with a display corresponding with a display that would have been displayed if the player had been playing the Class III game and had won the selected Class III award according to the selected sequence. The random selection may be weighted according to the relative frequencies of occurrence of the main and special sequences.

Some embodiments provide a method of adapting a Class II game to provide play characteristics of a Class III game. The method may include simulating a plurality of plays of the Class III game in a computer to obtain frequencies of occurrence of at least one Class III award. The method may include simulating a plurality of plays of the Class II game in a computer to obtain frequencies of occurrence of at least one Class II outcome. The method may include selecting a Class III award. The method may include selecting a Class II outcome that has a similar frequency of occurrence to the selected Class III award. The method may include defining an award for the selected Class II outcome according to the selected Class III award.

In some embodiments, the method may further include displaying an outcome corresponding with the selected Class III award when a subset of the selected Class II outcome occurs during play of the Class II game. In some embodiments, the method may further include providing a display corresponding with a display that would have been displayed if the player had been playing the Class III game and had won the selected Class III award when the selected Class II outcome occurs during play of the Class II game.

In some embodiments, the method may further include obtaining, from the Class III game simulation, relative frequencies of occurrences of main and special sequences that yield the selected Class III award. The method may also include randomly selecting a main or a special sequence that yields the selected Class III award when the selected Class II outcome occurs during play of the Class II game. A display corresponding with a display that would have been displayed if the player had been playing the Class III game and had won the selected Class III award according to the selected sequence may be provided. Randomly selecting the main or special sequence may include weighting the random selection according to the obtained relative frequencies of occurrence of the main and special sequences.

In some embodiments, the method may further include grouping the Class III awards according to ranges of awards. Defining an award for the selected Class II outcome may include defining an award according to awards in the Class III award group that includes the selected Class III award. The method may further include obtaining, from the Class III game simulation, relative frequencies of occurrences of main and special sequences that yield awards in the Class III award group that includes the selected Class III award. A main or a special sequence that yields an award in the Class III award group that includes the selected Class III award when the selected Class II outcome occurs during play of the Class II game may be randomly selected. A display corresponding with a display that would have been displayed if the player had been playing the Class III game and had won the given Class III award according to the selected sequence may be presented. Randomly selecting the main or special sequence may include weighting the random selection according to the obtained relative frequencies of occurrence of the main and special sequences.

In some embodiments, the method may further include running a second simulation of a plurality of plays of the Class II game in a computer using the defined awards of the selected Class II outcomes. The defined awards of the Class II outcomes may be adjusted according to any differences between awards awarded in the second simulation of the Class II game and awards awarded in the simulation of the Class III game.

Some embodiments provide a computer system configured to adapt a Class II game to provide play characteristics of a Class III game. The computer system may include: one or more memories and/or one or more processors communicatively coupled with the one or more memories. The one or more processors may be configured to: simulate a plurality of plays of the Class III game in a computer to obtain frequencies of occurrence of at least one Class III award; simulate a plurality of plays of the Class II game in a computer to obtain frequencies of occurrence of at least one Class II outcome; select a Class III award; select a Class II outcome that has a similar frequency of occurrence to the selected Class III award; and/or define an award for the selected Class II outcome according to the selected Class III award.

In some embodiments, the one or more processors may be further configured to display an outcome corresponding with the selected Class III award when a subset of the selected Class II outcome occurs during play of the Class II game. The one or more processors may be further configured to provide a display corresponding with a display that would have been displayed if the player had been playing the Class III game and had won the selected Class III award when the selected Class II outcome occurs during play of the Class II game.

In some embodiments, the one or more processors may be further configured to: obtain, from the Class III game simulation, relative frequencies of occurrences of main and special sequences that yield the selected Class III award; randomly select a main or a special sequence that yields the selected Class III award when the selected Class II outcome occurs during play of the Class II game; and/or provide a display corresponding with a display that would have been displayed if the player had been playing the Class III game and had won the selected Class III award according to the selected sequence. Randomly selecting the main or special sequence may include weighting the random selection according to the obtained relative frequencies of occurrence of the main and special sequences.

Some embodiments provide a computer program product for adapting a Class II game to provide play characteristics of a Class III game. The computer program product includes a non-transitory computer-readable medium that may include: code for simulating a plurality of plays of the Class III game in a computer to obtain frequencies of occurrence of at least one Class III award; code for simulating a plurality of plays of the Class II game in a computer to obtain frequencies of occurrence of at least one Class II outcome; code for selecting a Class III award; code for selecting a Class II outcome that has a similar frequency of occurrence to the selected Class III award; and/or code for defining an award for the selected Class II outcome according to the selected Class III award.

In some embodiments, the non-transitory computer-readable medium may further include code for grouping the Class III awards according to ranges of awards. Defining an award for the selected Class II outcome may include defining an award according to awards in the Class III award group that includes the selected Class III award. In some embodiments, the non-transitory computer-readable medium may, further include: code for obtaining, from the Class III game simulation, relative frequencies of occurrences of main and special sequences that yield awards in the Class III award group that includes the selected Class III award; code for randomly selecting a main or a special sequence that yields an award in the Class III award group that includes the selected Class III award when the selected Class II outcome occurs during play of the Class II game; and/or code for providing a display corresponding with a display that would have been displayed if the player had been playing the Class III game and had won the given Class III award according to the selected sequence. Randomly selecting the main or special sequence may include weighting the random selection according to the obtained relative frequencies of occurrence of the main and special sequences.

In some embodiments, the non-transitory computer-readable medium may further include code for running a second simulation of a plurality of plays of the Class II game in a computer using the defined awards of the selected Class II outcomes; and/or code for adjusting the defined awards of the Class II outcomes according to any differences between awards awarded in the second simulation of the Class II game and awards awarded in the simulation of the Class III game.

Other aspects and embodiments of the invention will be described in the drawings and the following detailed description, illustrating by example the principles of the invention.

DETAILED DESCRIPTION

Figure 1:
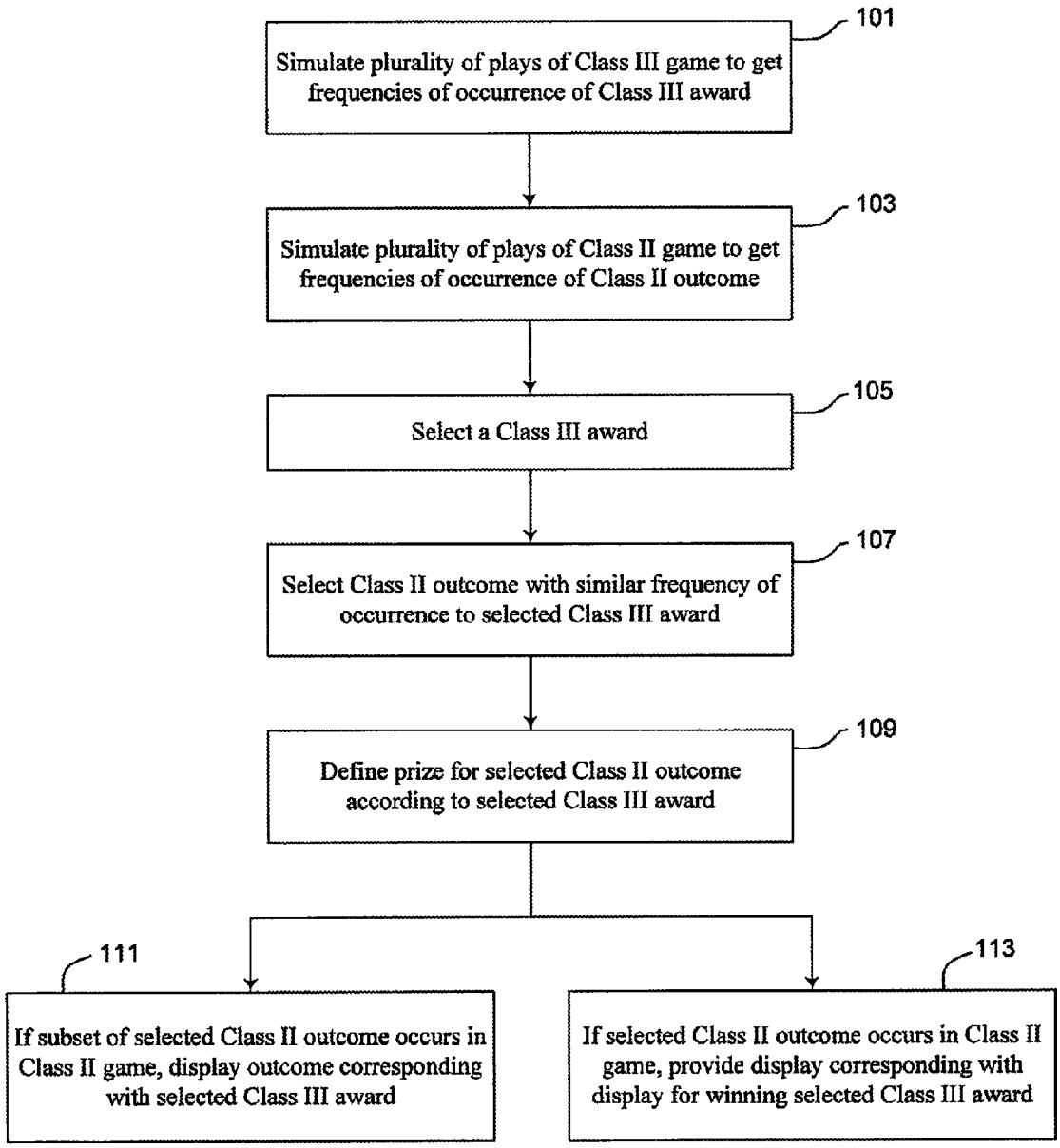
FIG. 1 is a flowchart illustrating a method of adapting a Class II game to provide the game play characteristics of a Class III game in accordance various embodiments.

A method of adapting a Class II game to provide play characteristics of a Class III game according to an aspect of the invention is depicted in FIG. 1. The method includes simulating a plurality of plays of the Class III game in a computer to obtain frequencies of occurrence of at least one Class III award (101); simulating a plurality of plays of the Class II game in a computer to obtain frequencies of occurrence of at least one Class II outcome (103); selecting a Class III award (105); selecting at least one Class II outcome that has a similar frequency of occurrence to the selected Class III award (107); and defining an award for the selected Class II outcome(s) according to the selected Class III award (109).

In some embodiments the method also includes displaying an outcome corresponding with the selected Class III award if a subset of the selected Class II outcome occurs during play of the Class II game (111). In some embodiments the method also includes providing a display corresponding with a display that would have been displayed if the player had been playing the Class III game and had won the selected Class III award, if the selected Class II outcome occurs during play of the Class II game (113).

Figure 2:
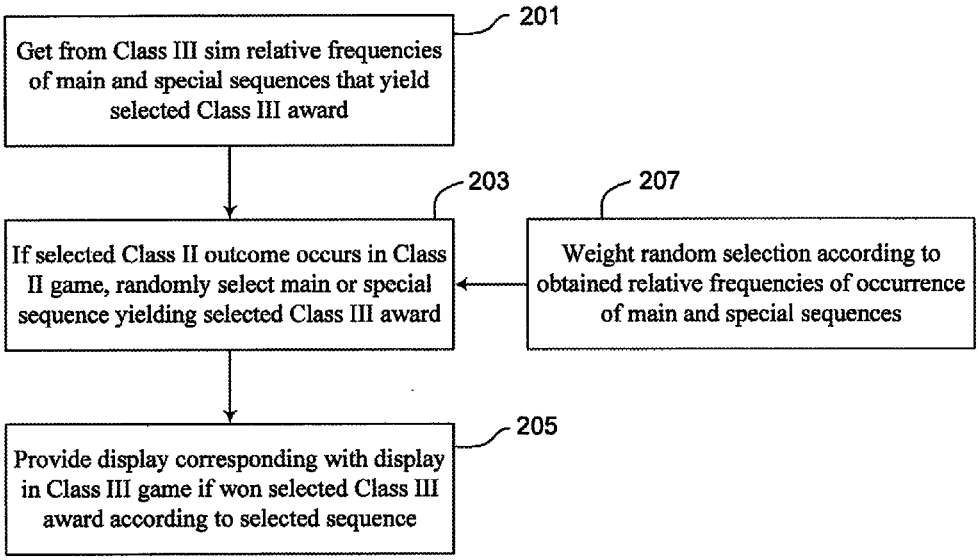
FIG. 2 is a flowchart illustrating a method of selecting a main or special sequence in accordance with various embodiments.

Turning now to FIG. 2, in some embodiments relative frequencies of occurrences of main and special sequences that yield the selected Class III award are obtained from the Class III game simulation (201). When the selected Class II outcome occurs during play of the Class II game, a main or a special sequence that yields the selected Class III award is randomly selected (203). A display is provided that corresponds with a display that may have been displayed if the player had been playing the Class III game and had won the selected Class III award according to the selected sequence (205).

Randomly selecting the main or special sequence may comprise weighting the random selection according to the obtained relative frequencies of occurrence of the main and special sequences (207). In some embodiments, no weighting of the sequences occurs; rather, the relative frequencies of sequences generated from the Class III game simulation are utilized directly.

Figure 3:
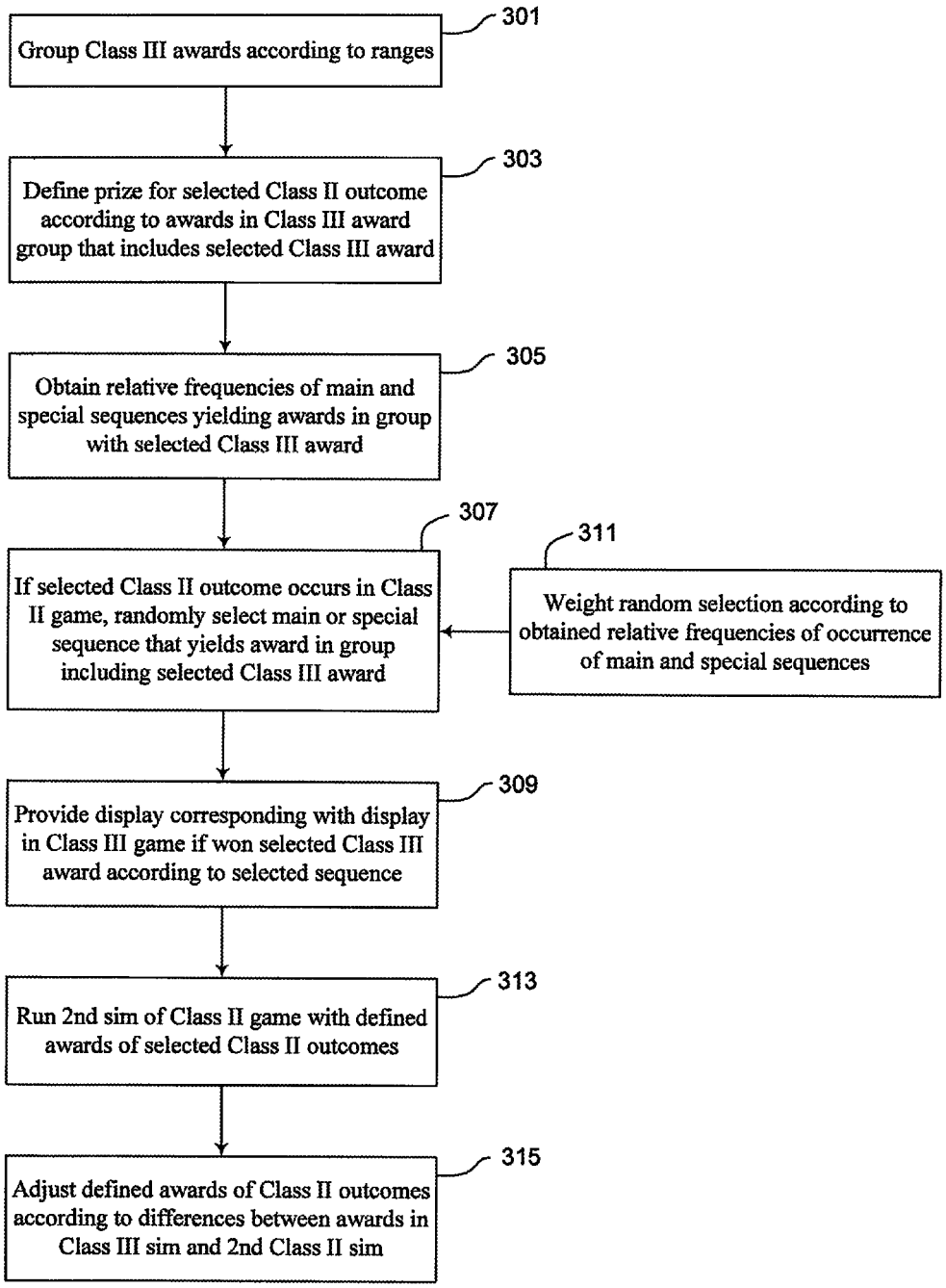
FIG. 3 is a flowchart illustrating a method similar to that of FIG. 2 but also including grouping of awards in accordance with various embodiments.

In another embodiment, and as shown FIG. 3, Class III awards are grouped according to proximity ranges of awards (301). That is, Class III awards are grouped to a common award within the group. An award is then defined for the selected Class II outcome according to awards in the Class III award group that includes the selected Class III award (303). Relative frequencies of occurrences of main and special sequences that yield awards in the Class III award group that includes the selected Class III award are obtained from the Class III game simulation (305). When the selected Class II outcome occurs during play of the Class II game, a main or a special sequence is randomly selected; the selected sequence is one that yields an award in the Class III award group that includes the selected Class III award (307). A display is provided that corresponds with a display that would have been displayed if the player had been playing the Class III game and had won the given Class III award according to the selected sequence (309). Randomly selecting the main or special sequence may include weighting the random selection according to the obtained relative frequencies of occurrence of the main and special sequences (311).

Some embodiments include running a second simulation of a plurality of plays of the Class II game in a computer using the defined awards of the selected Class II outcomes (313) and adjusting the defined awards of the Class II outcomes according to any differences between awards awarded in the second simulation of the Class II game and awards awarded in the simulation of the Class III game (315).

In one example, 100 million plays of a Class III slot-machine game titled "Bugs to Riches" developed by American Gaming Systems of Las Vegas, Nev., assignee of the present patent application, were simulated in a computer. Such simulations may be carried out in any general-purpose computer under control of software of a kind that is well known in the art. The software should have a good quality random number generator for best results of such a simulation.

Table I shows the top-level results of the simulation and Table shows the relative frequencies of various award intervals and the percentage that each award contributed to the overall total payout. The information in Table II is depicted graphically in FIG. 4A.

TABLE I

| | |
|---|---|
| Payout % | 93.56% |
| Hit Frequency | 47.33% |
| "Bugs" Bonus Frequency (1 in × games) | 59 |
| "Bugs" Bonus Contribution | 29.23% |
| Free Spin Bonus Frequency (1 in × games) | 92 |
| Free Spin Bonus Contribution | 26.20% |
| 90% Volatility Index | 8.07 |

TABLE II

| Award Intervals (×total wager) | Frequency | Contribution |
|---|---|---|
| 0.5 | 28.370% | 6.953% |
| 1 | 8.243% | 6.168% |
| 2 | 4.537% | 6.476% |
| 3 | 1.623% | 4.154% |
| 4 | 1.011% | 3.486% |
| 5 | 0.344% | 1.563% |
| 7 | 0.437% | 2.626% |
| 10 | 0.666% | 5.619% |
| 15 | 0.612% | 7.685% |
| 20 | 0.421% | 7.315% |

TABLE II-continued

| Award Intervals (×total wager) | Frequency | Contribution |
|---|---|---|
| 25 | 0.285% | 6.408% |
| 30 | 0.202% | 5.538% |
| 40 | 0.234% | 8.090% |
| 50 | 0.139% | 6.230% |
| 75 | 0.151% | 8.991% |
| 100 | 0.050% | 4.307% |
| 250 | 0.014% | 1.571% |
| >250 | 0.001% | 0.383% |

A Class III game such as "Bugs to Riches" may produce as many as 1,000 different awards so that a player who plays this game will experience different levels of excitement. However, existing Bingo patterns may produce a maximum of only about 100 different awards that a player may he able to see and win. It may be desirable to make a Bingo game that has the play characteristics of a Class III game so that the player might see a rich award space of 1,000 or more different awards.

Accordingly, to create a rich Class II award space so as to be able to more readily match the frequencies of payouts observed in the Class III simulations, the rules of a Bingo game may be stated as follows:

Minimum of two players to start a game.

Game ending pattern is "cover-all." In other words, the player has to cover all 24 elements on his/her Bingo card. A player that does this wins the Bingo award of 0.5% of the total wagered by all players. The percentage contributed to the Bingo award may be higher or lower than 0.5%.

If a player achieves a "cover-all" within the first 31 numbers drawn, play continues until 31 numbers have been drawn, and then the game ends. If no player achieves a "cover-all" within the first 31 numbers drawn, play continues until at least one player achieves a "cover-all" and then the game ends. Alternatively, if no player achieves a "cover-all" within the first 31 numbers drawn, play continues until the maximum number of balls for which a pay is possible are drawn. The ball number, 31, for which may end the bingo game may be different for different games, 22 pre-defined patterns provide various opportunities for interim and consolation awards while the game is in progress. The number of patterns, 22, for the consolation prizes may be different for different games, The minimum number of balls required to win an award is two.

Following is an example of the order of play for a Bingo game according to the foregoing rules. Two or more players participate in the game. The game consists of sequential randomly drawing of numbers between 1 and 75. Typically this is done by marking one such number on each of 75 balls such as ping-pong balls and then drawing the balls at random. This may be done manually or by machine or computer with the aid of a random number generator. After the draw of each ball, if a player achieved any of the 22 predefined patterns, the player receives an award but the game continues and the player remains eligible to receive other awards. If a player is the first to achieve the game-ending "cover-all" pattern of all 24 elements covered on his/her card, this player wins the additional award of 0.5% of the total bet from all players in the game. The game continues until at least 31 numbers have been drawn and at least one player has covered all 24 elements on his/her card. Because these rules allow players to accumulate awards until the game ends, and allow players to win based on a variety of patterns completed on different numbers of balls drawn, the number of possible awards attainable by players exceeds 1,000.

Figure 5:
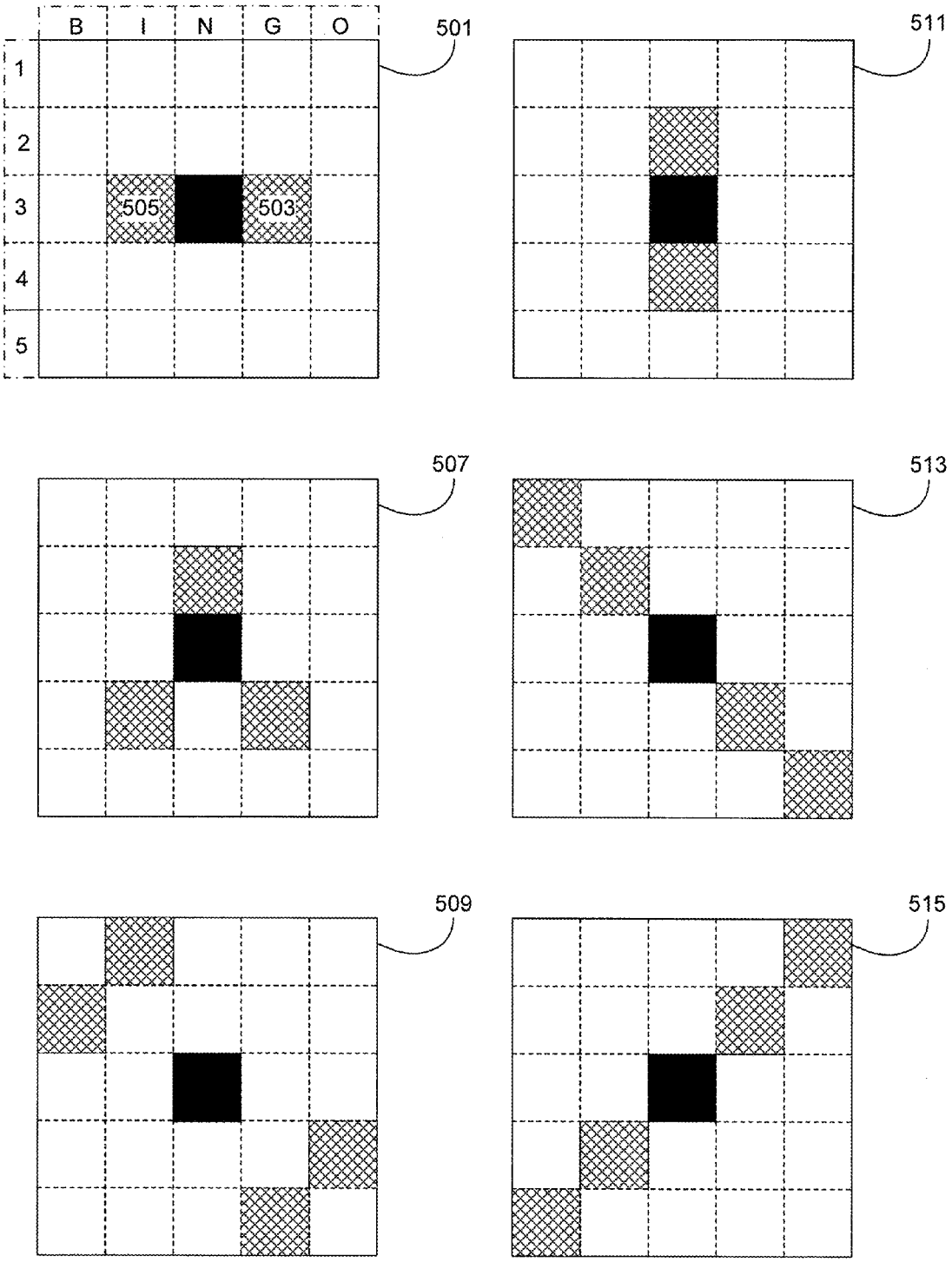
FIG. 5 is a pictorial representation of six possible winning patterns in a Bingo game.

FIG. 5 illustrates six pre-defined patterns. Pattern 501 earns a player an award for covering the element 503 at the intersection of the "G" column and the third row and the element 505 at the intersection of the "I" column and the third row. Pattern 507 earns an award for covering the elements at the intersections of the second row with the "N" column, the fourth row with the "I" column, and the fourth row with the "G" column. Pattern 509 earns an award for covering the intersections of the first row with the "I" column, the second row with the "B" column, the fourth row with the "O" column, and the fifth row with the "G" column. Pattern 511 earns an award for covering the elements at the intersections of the second and fourth rows with the "N" column. Patterns 513 and 515 earn awards for down-to-the-right and up-to-the-right diagonal patterns, respectively.

A portion of a sample paytable for this Bingo game appears in Table III. This table includes entries for the six exemplary patterns shown in FIG. 5 and for several other patterns. Some of the 22 patterns that would be used in a complete game are not included in the table.

TABLE III

| Number of | Pattern: | | | | | | | | | | | | |
|---|---|---|---|---|---|---|---|---|---|---|---|---|---|
| Balls Drawn | 501 | 511 | 3 | 507 | 509 | 6 | 513 | 515 | 9 | 10 | 11 | 12 | 13 |
| 2 | 200 | 155 | 0 | 0 | 0 | 0 | 0 | 0 | 0 | 0 | 0 | 0 | 0 |
| 3 | 190 | 145 | 0 | 0 | 0 | 0 | 0 | 0 | 0 | 0 | 0 | 0 | 0 |
| 4 | 170 | 0 | 1100 | 1100 | 1120 | 1180 | 1200 | 1220 | 1240 | 1280 | 0 | 0 | 0 |
| 5 | 145 | 0 | 0 | 1100 | 1120 | 1140 | 1200 | 1220 | 1240 | 1280 | 20090 | 20275 | 20290 |
| 6 | 0 | 0 | 0 | 0 | 0 | 0 | 0 | 0 | 0 | 0 | 0 | 0 | 20090 |
| 7 | 0 | 0 | 0 | 0 | 0 | 0 | 0 | 0 | 0 | 0 | 0 | 0 | 20090 |
| 8 | 85 | 85 | 95 | 95 | 175 | 280 | 400 | 600 | 800 | 980 | 1000 | 1200 | 1600 |
| 9 | 35 | 40 | 90 | 90 | 175 | 275 | 380 | 580 | 780 | 960 | 1000 | 1180 | 1580 |
| 10 | 35 | 35 | 85 | 85 | 170 | 270 | 370 | 570 | 760 | 940 | 980 | 1165 | 1560 |
| 11 | 30 | 30 | 40 | 80 | 170 | 245 | 265 | 350 | 550 | 820 | 960 | 1150 | 1470 |
| 12 | 30 | 30 | 35 | 40 | 150 | 240 | 260 | 340 | 540 | 740 | 940 | 1140 | 1450 |
| 13 | 25 | 25 | 30 | 35 | 145 | 235 | 180 | 640 | 520 | 720 | 920 | 1140 | 1420 |
| 14 | 20 | 20 | 20 | 20 | 140 | 230 | 255 | 300 | 500 | 700 | 900 | 1120 | 1400 |
| 15 | 20 | 20 | 20 | 20 | 140 | 225 | 255 | 125 | 475 | 680 | 880 | 1120 | 1380 |
| 16 | 20 | 20 | 20 | 20 | 135 | 220 | 250 | 295 | 475 | 660 | 920 | 1100 | 1360 |
| 17 | 20 | 20 | 20 | 20 | 130 | 180 | 250 | 295 | 450 | 640 | 900 | 1080 | 620 |
| 18 | 20 | 20 | 20 | 20 | 125 | 175 | 215 | 290 | 25 | 620 | 880 | 1060 | 1320 |
| 19 | 20 | 20 | 20 | 20 | 475 | 170 | 210 | 285 | 420 | 90 | 860 | 1040 | 1300 |
| 20 | 20 | 20 | 20 | 20 | 90 | 165 | 205 | 285 | 420 | 185 | 620 | 500 | 1040 |

TABLE III-continued

| Number of Balls Drawn | Pattern: 501 | 511 | 3 | 507 | 509 | 6 | 513 | 515 | 9 | 10 | 11 | 12 | 13 |
|---|---|---|---|---|---|---|---|---|---|---|---|---|---|
| 21 | 5 | 5 | 5 | 5 | 90 | 130 | 135 | 145 | 620 | 180 | 660 | 840 | 840 |
| 22 | 10 | 10 | 15 | 15 | 25 | 25 | 25 | 25 | 100 | 160 | 205 | 290 | 320 |
| 23 | 5 | 5 | 15 | 10 | 15 | 15 | 35 | 40 | 40 | 155 | 55 | 55 | 60 |
| 24 | 5 | 5 | 15 | 10 | 15 | 15 | 20 | 20 | 20 | 150 | 55 | 55 | 60 |
| 25 | 5 | 5 | 15 | 10 | 15 | 15 | 20 | 20 | 20 | 45 | 55 | 55 | 60 |
| 26 | 5 | 5 | 5 | 5 | 5 | 5 | 5 | 5 | 5 | 45 | 45 | 50 | 50 |
| 27 | 5 | 5 | 5 | 5 | 5 | 5 | 5 | 5 | 5 | 45 | 45 | 50 | 50 |
| 28 | 5 | 5 | 5 | 5 | 5 | 5 | 5 | 5 | 5 | 40 | 30 | 30 | 30 |
| 29 | 5 | 5 | 5 | 5 | 5 | 5 | 5 | 5 | 5 | 25 | 30 | 30 | 30 |
| 30 | 0 | 5 | 5 | 5 | 5 | 5 | 5 | 5 | 5 | 25 | 30 | 30 | 30 |
| 31 | 0 | 0 | 5 | 5 | 5 | 5 | 5 | 5 | 5 | 5 | 5 | 10 | 10 |
| [32-74 omitted] | | | | | | | | | | | | | |
| 75 | 0 | 0 | 0 | 0 | 0 | 0 | 0 | 0 | 0 | 0 | 0 | 0 | 0 |

The first column is number of balls drawn.

For example, assume a player wagers 40 credits. On the 10th ball, the player achieves pattern 501, and later on at the 26th ball, the player achieves pattern 515. At this point, the player has won 35+5=40 credits. The player remains eligible to win additional awards until the Bingo game ends.

The Class III statistical results from the simulation can be used to map the Class III results onto the Class II Bingo results. A typical Class III game has so many possible awards that each individual award need not be reproduced under the teachings herein. Rather, similar awards (that is, awards of similar numeric value) may be grouped into one award to be reproduced in the Class II game. When doing so, typically the most frequent award value is chosen to represent the grouping. Such a grouping selection is shown in Table IV.

TABLE IV

| Group | Award value | Number of times award appears | Selection |
|---|---|---|---|
| A | 20260 | 9 | |
| A | 20120 | 100 | X |
| A | 20085 | 4 | |
| B | 4140 | 118 | |
| B | 4135 | 500 | X |
| B | 4130 | 126 | |
| B | 4100 | 126 | |
| B | 4095 | 135 | |
| C | 3415 | 236 | |
| C | 3410 | 1000 | X |
| C | 3405 | 226 | |
| C | 3400 | 292 | |
| C | 3375 | 244 | |
| D | 2425 | 244 | |
| D | 2420 | 706 | X |
| D | 2415 | 226 | |
| D | 2410 | 226 | |
| D | 2405 | 236 | |

TABLE IV-continued

| Group | Award value | Number of times award appears | Selection |
|---|---|---|---|
| D | 2400 | 226 | |
| E | 1015 | 3496 | |
| E | 1010 | 4604 | |
| E | 1005 | 4790 | |
| E | 1000 | 8659 | X |
| F | 755 | 5316 | |
| F | 750 | 6923 | |
| F | 745 | 7518 | |
| F | 740 | 14084 | X |
| F | 720 | 3500 | |
| F | 700 | 2100 | |
| | 35 | 1145100 | X |
| | 30 | 1723419 | X |
| | 25 | 3583450 | X |
| | 20 | 4129360 | X |
| | 15 | 2697504 | X |
| | 10 | 7415018 | X |

Table IV shows how frequently an award occurs. For example, "20260, 20120, 20085" are in a similar award range (group A in the table), and since award 20120 occurs more often than the other two awards in that group, award "20120" is selected. Similarly, awards "4135" (group B), "3410" (group C), "2420" (group D), "1000" (group F), and "740" (group F) are selected. The smaller awards in the last six rows of the table that players will see more often are all selected.

A Bingo simulation program uses a Bingo paytable such as Table III and simulates a Bingo game with just one player. The number of Bingo games to be simulated can be changed. The output of this program is the simulated result that includes Payout %, awards and the distribution on different intervals, and probabilities of all the defined bingo patterns. The probabilities of bingo patterns per number of draws yields a chart of mathematical probabilities. A portion of these probabilities is shown by example in Table V.

TABLE V

| Number of balls drawn | GEP | Pattern 501 | Pattern 511 | Pattern 3 | Pattern 507 | Pattern 509 | Pattern 6 | Pattern 513 |
|---|---|---|---|---|---|---|---|---|
| 2 | 0.00E+00 | 3.61E−04 | 3.62E−04 | 0.00E+00 | 0.00E+00 | 0.00E+00 | 0.00E+00 | 0.00E+00 |
| 3 | 0.00E+00 | 7.18E−04 | 7.24E−04 | 1.49E−05 | 1.47E−05 | 0.00E+00 | 0.00E+00 | 0.00E+00 |
| 4 | 0.00E+00 | 1.08E−03 | 1.08E−03 | 4.44E−05 | 4.43E−05 | 7.23E−07 | 7.46E−07 | 8.47E−07 |
| 5 | 0.00E+00 | 1.44E−03 | 1.44E−03 | 8.87E−05 | 8.93E−05 | 3.19E−06 | 3.40E−06 | 3.32E−06 |
| 6 | 0.00E+00 | 1.81E−03 | 1.80E−03 | 1.47E−04 | 1.49E−04 | 8.37E−06 | 8.28E−06 | 8.43E−06 |
| 7 | 0.00E+00 | 2.16E−03 | 2.16E−03 | 2.20E−04 | 2.22E−04 | 1.62E−05 | 1.65E−05 | 1.64E−05 |

TABLE V-continued

| Number of balls drawn | GEP | Pattern 501 | Pattern 511 | Pattern 3 | Pattern 507 | Pattern 509 | Pattern 6 | Pattern 513 |
|---|---|---|---|---|---|---|---|---|
| 8 | 0.00E+00 | 2.52E−03 | 2.51E−03 | 3.08E−04 | 3.09E−04 | 2.87E−05 | 2.89E−05 | 2.91E−05 |
| 9 | 0.00E+00 | 2.88E−03 | 2.87E−03 | 4.11E−04 | 4.12E−04 | 4.56E−05 | 4.60E−05 | 4.62E−05 |
| 10 | 0.00E+00 | 3.25E−03 | 3.24E−03 | 5.29E−04 | 5.29E−04 | 6.93E−05 | 6.87E−05 | 6.89E−05 |
| 11 | 0.00E+00 | 3.60E−03 | 3.60E−03 | 6.63E−04 | 6.61E−04 | 9.84E−05 | 9.91E−05 | 9.93E−05 |
| 12 | 0.00E+00 | 3.96E−03 | 3.96E−03 | 8.12E−04 | 8.11E−04 | 1.36E−04 | 1.36E−04 | 1.36E−04 |
| 13 | 0.00E+00 | 4.31E−03 | 4.32E−03 | 9.73E−04 | 9.73E−04 | 1.81E−04 | 1.81E−04 | 1.81E−04 |
| 14 | 0.00E+00 | 4.68E−03 | 4.67E−03 | 1.15E−03 | 1.15E−03 | 2.35E−04 | 2.34E−04 | 2.33E−04 |
| 15 | 0.00E+00 | 5.03E−03 | 5.03E−03 | 1.34E−03 | 1.34E−03 | 2.99E−04 | 2.98E−04 | 2.99E−04 |
| 16 | 0.00E+00 | 5.41E−03 | 5.40E−03 | 1.55E−03 | 1.55E−03 | 3.73E−04 | 3.76E−04 | 3.73E−04 |
| 17 | 0.00E+00 | 5.76E−03 | 5.75E−03 | 1.77E−03 | 1.77E−03 | 4.60E−04 | 4.59E−04 | 4.58E−04 |
| 18 | 0.00E+00 | 6.12E−03 | 6.12E−03 | 2.00E−03 | 2.00E−03 | 5.58E−04 | 5.60E−04 | 5.59E−04 |
| 19 | 0.00E+00 | 6.48E−03 | 6.46E−03 | 2.25E−03 | 2.25E−03 | 6.68E−04 | 6.69E−04 | 6.67E−04 |
| 20 | 0.00E+00 | 6.84E−03 | 6.83E−03 | 2.52E−03 | 2.52E−03 | 7.96E−04 | 7.98E−04 | 7.95E−04 |
| 21 | 0.00E+00 | 7.20E−03 | 7.19E−03 | 2.80E−03 | 2.80E−03 | 9.33E−04 | 9.37E−04 | 9.31E−04 |
| 22 | 0.00E+00 | 7.56E−03 | 7.54E−03 | 3.09E−03 | 3.09E−03 | 1.09E−03 | 1.10E−03 | 1.09E−03 |
| 23 | 0.00E+00 | 7.92E−03 | 7.91E−03 | 3.40E−03 | 3.41E−03 | 1.26E−03 | 1.26E−03 | 1.26E−03 |

The first column is number of balls drawn.

As an example of reading Table V, the entry:

5.76 E-03 in the Pattern 501 column at number of balls drawn 17 means that precisely upon 17 balls drawn there is a probability of 0.00576 that Pattern 1 will be filled on any given card.

Figure 4A:
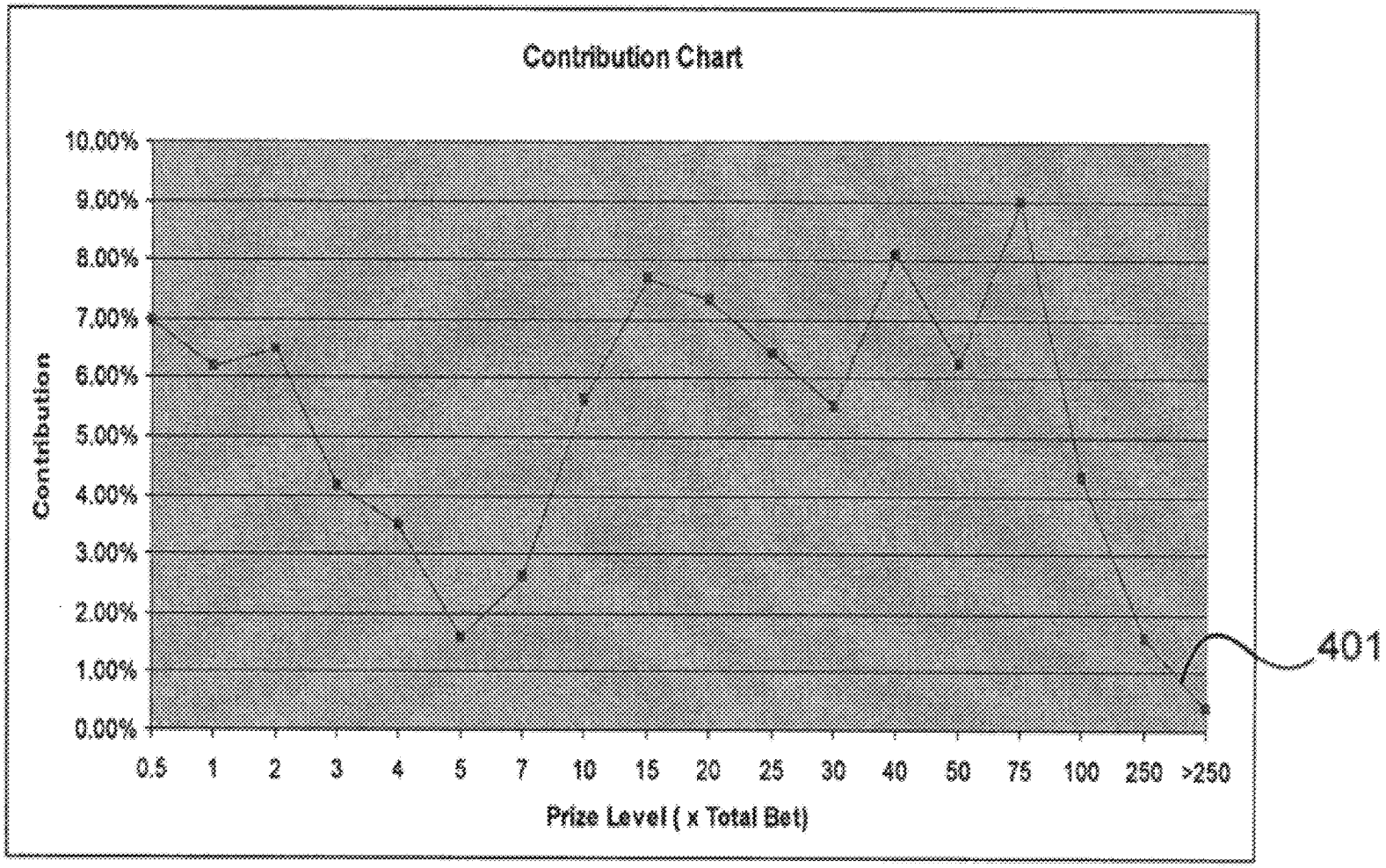
FIG. 4A is a graphical depiction of relative contributions of various award levels in a simulation of a Class III game.
Figure 4B:
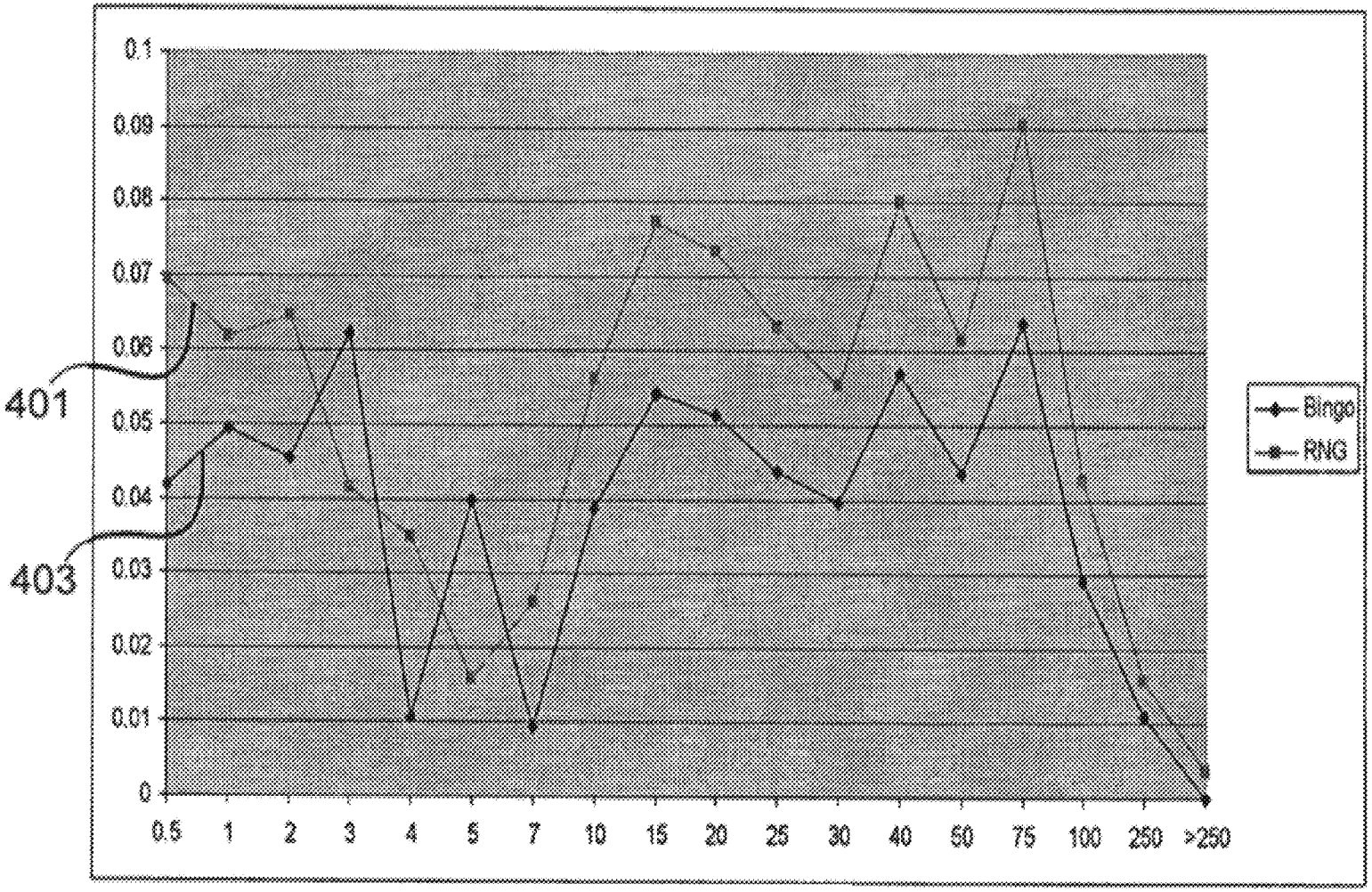
FIG. 4B is a graphical depiction of relative contributions of various award levels in a simulation of a Class II game, compared with the depiction of FIG. 4A.
Figure 4C:
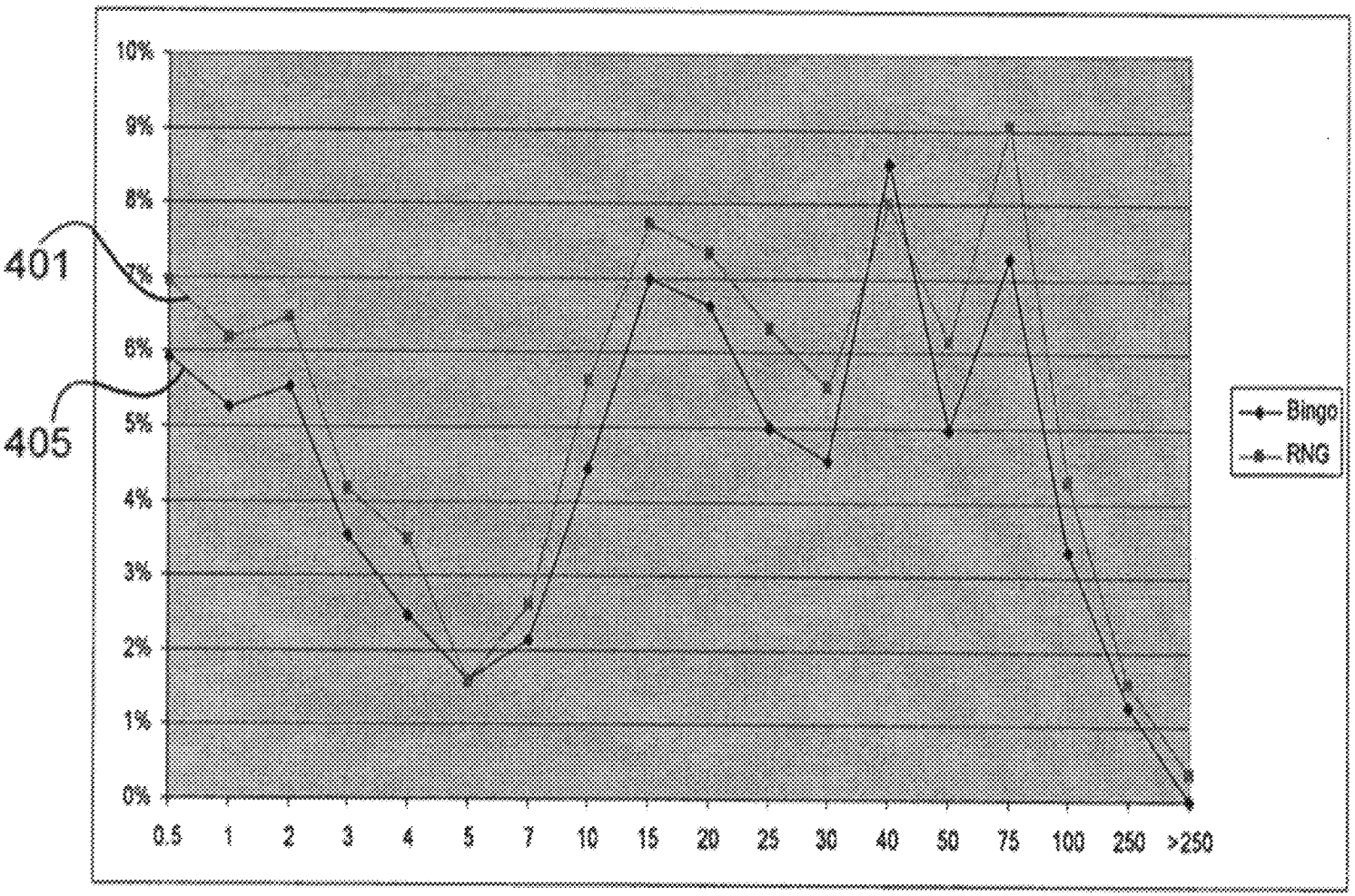
FIG. 4C is a graphical depiction of relative contributions of various award levels in a simulation of a Class II game after a first adjustment, compared with the depiction of FIG. 4A.
Figure 4D:
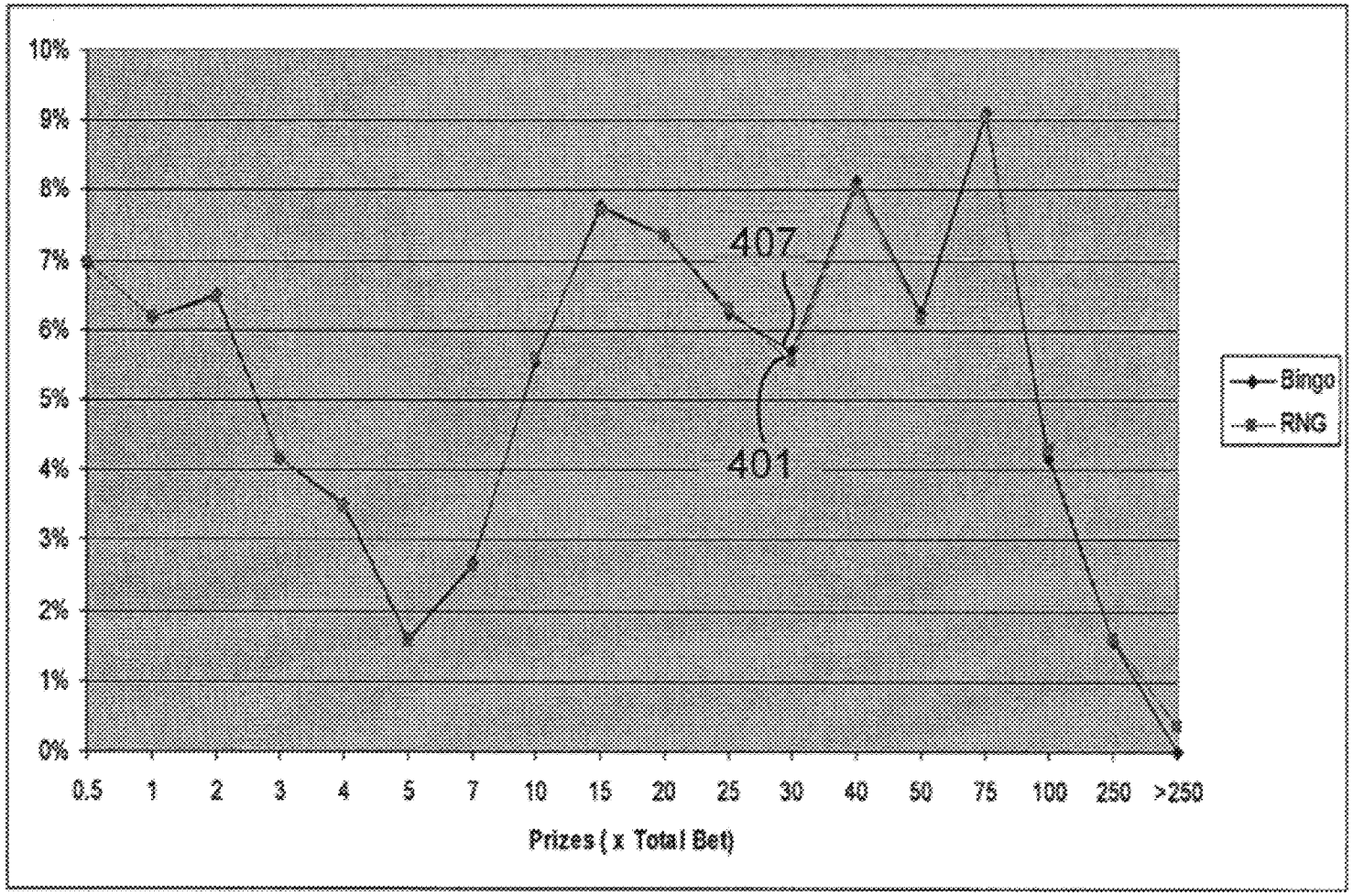
FIG. 4D is a graphical depiction of relative contributions of various award levels in a simulation of a Class II game after a second adjustment compared with the depiction of FIG. 4A.
Figure 4E:
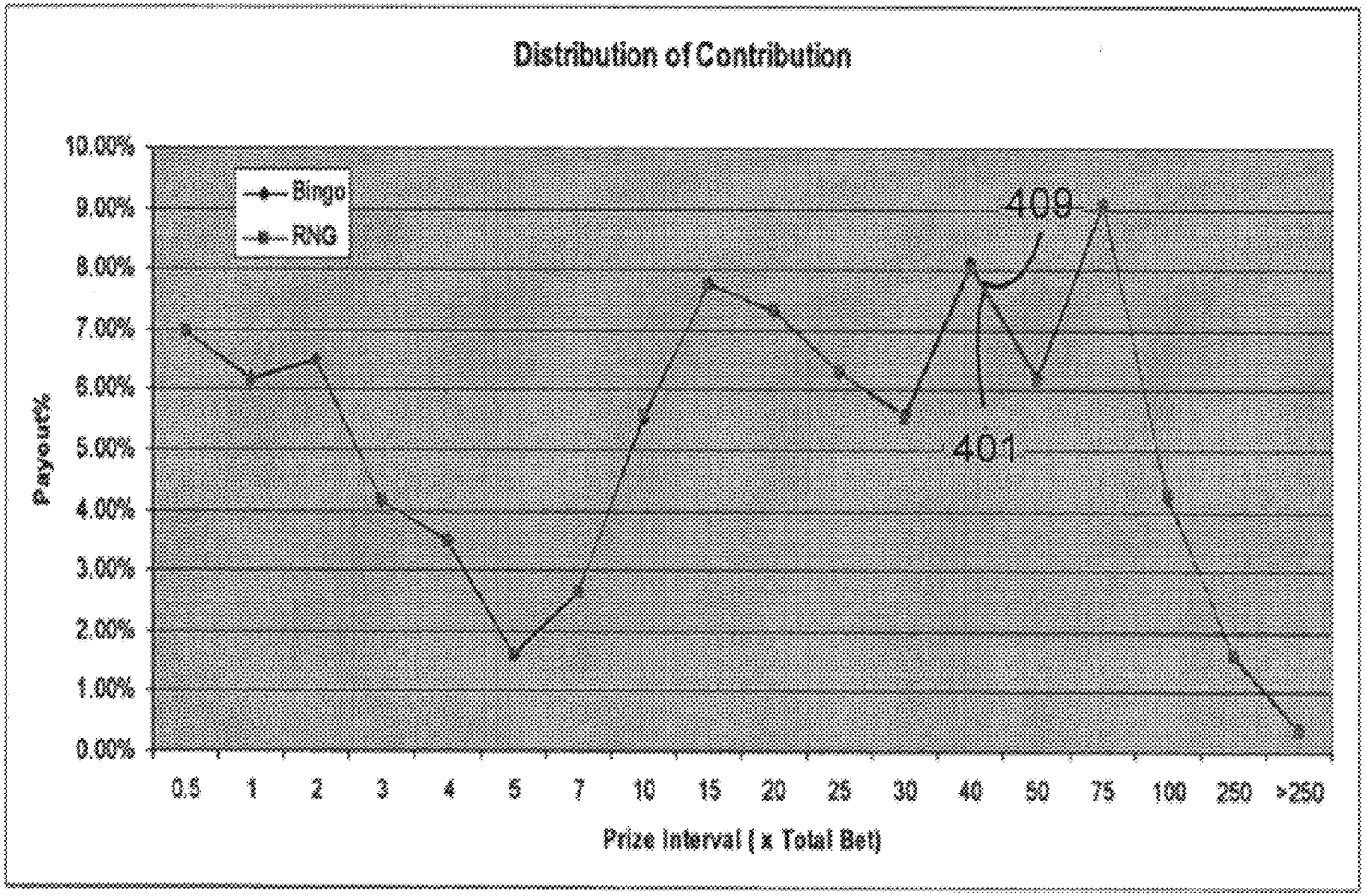
FIG. 4E is a graphical depiction of relative contributions of various award levels in a simulation of a Class II game after a third adjustment, compared with the depiction of FIG. 4A.

From a complete version of Table V, a graph similar to that in FIG. 4A can be constructed. FIG. 4B shows such a graph 403, together with the graph 401 for comparison. It will be seen that the Bingo (Class II game) graph 403 differs from the Class III game depicted by graph 401. The Bingo paytable can be refined by increasing and decreasing some of the awards. By iteratively refining the Bingo paytable, successive refinements as shown in FIG. 4C (graph 405) and FIG. 4D (graph 407) ultimately provide a Bingo (Class II game) having a graph 409 as shown in FIG. 4E that is virtually indistinguishable from the graph 401 for the Class III game.

From the "Payout %" to the "Hit Frequency" to the "Volatility Index" (Table I), the results of the Class II Bingo simulations match closely the results of the Class III simulations.

The "Correlation Coefficient" is an index ranging from 0 to 1 that determines the relationship between two functions or data sets. In this case, it compares the simulation results of the Class II and Class III simulations on "contribution on different award intervals." A value of zero for the correlation coefficient suggests that the two functions have no relation to each other, whereas a value of one suggests that the two functions are identical. The actual correlation coefficient between the Class II and Class III simulations is 0.90, showing that the Class II Bingo Paytable produced as described above will generate very similar results as the simulated Class III game (in this case, the "Bugs to Riches" game). The overall play, in terms of the mathematical properties including payoffs, frequencies and volatility, between the two will be very similar.

There are other attributes that can contribute to the interest and excitement of a Class III game and that can also be included in the adaptation of the Class II game to help give it the play characteristics of the Class III game. These attributes are the special sequences such as Bonus Games including, as applicable, Free Spin Bonus Games. How often a special sequence occurs, and how much an award results when a player enters such a sequence, can he factors in generating the desired level of interest and excitement in the Class III game that can be reproduced in the Class II game.

The frequency with which special sequences occur can be determined from the Class III simulation, as shown in exemplary Table VI.

TABLE VI

| Award | Quantity | Total Win | Main Sequence | Free Spins Bonus Sequence | "Bugs" Bonus Sequence |
|---|---|---|---|---|---|
| 245 | 19578 | 4796610 | 11171 | 1820 | 6587 |
| 240 | 35863 | 8607120 | 10844 | 1648 | 23371 |
| 235 | 14017 | 3293995 | 11467 | 1848 | 702 |
| 230 | 18128 | 4169440 | 13931 | 1542 | 2655 |
| 225 | 33168 | 7462800 | 24166 | 1671 | 7331 |
| 220 | 46898 | 10317560 | 19649 | 1537 | 25712 |
| 215 | 16231 | 3489665 | 13964 | 1554 | 713 |
| 210 | 23906 | 5020260 | 19934 | 1483 | 2489 |
| 205 | 30641 | 6281405 | 22569 | 1307 | 6765 |
| 200 | 70299 | 14059800 | 45110 | 1271 | 23918 |
| 195 | 17689 | 3449355 | 15772 | 1243 | 674 |
| 190 | 18663 | 3545970 | 15019 | 1114 | 2530 |
| 185 | 26977 | 4990745 | 18661 | 1160 | 7156 |
| 180 | 54398 | 9791640 | 27432 | 1125 | 25841 |
| 175 | 38688 | 6770400 | 36978 | 993 | 717 |
| 170 | 39257 | 6673690 | 35712 | 957 | 2588 |
| 165 | 51680 | 8527200 | 43435 | 887 | 7358 |
| 160 | 70351 | 11256160 | 43353 | 690 | 26308 |

From Table VI, it will he seen that, for example, the award "245" comes from the main sequence 57% of the time, from the main sequence plus a free spin bonus game 9.3% of the time, and from the main sequence plus the "Bugs" bonus game 33.6% of the time. Grouping the awards from the Class III game simulation provides the probabilities to be used in determining how often a special sequence should occur for any given Class II award.

To provide the game engine the logic on deciding what to display upon receiving a Bingo game result/award from the server, the game engine may utilize a chart of values that includes the frequencies of displaying Base Game, Bonus and/or Free Spin within certain prize ranges. The range of prize may be defined similarly to the range defined on the previous prize interval charts, and the frequencies can be derived from the Class III Simulation. This chart may be referred to as the Performance Table.

Merely by way of example, the following lines represent one range of awards that share the same probability to enter a bonus game or a free spin.

1. <AwardRange id="3" award_from="75" award_to="395" basegame_probability="8492">

-continued

```
2. <Feature id="1" probability="1248" />
3. <Feature id="2" probability="260" />
4. </AwardRange>
```

In Line 1, "AwardRange id=3" means that this range is the 3rd range defined in the Performance table. "Award_from=75 award_to=395" means that this range includes awards from "75" to "395" in credits that will share the same probabilities. "basegame_probability=8492" defines the probability that an award within "75" to "395" will have "8492" chances out of "8492+1248+260=10000," which is "8492/10000=84.92%" of chance to play just the Base game without any special features when the Bingo Server sends to game-engine an award within the "75 to 395" range. Following the same logic, the next line, Line 2, "Feature id=1 probability=1248" means that for Feature ID "1," which in this case is a Bonus game, will have 1248 chances out of 8492+1248+260=10000, which is 1248/10000=12.48% to enter Bonus game when the server sends to the game-engine an award in the "75 to 395" ranges. Therefore, Feature ID=2, which is Free Spin could have 2.60% chance to go when seeing an award of "75 to 395."

With several ranges of awards thusly defined, a performance table can be created for the game-engine to use in determining which special feature to play when a given award is attained.

Next is to consider awards that might occur in the main sequence before triggering a special sequence. In a Class III game it is possible to win an award in a main sequence and simultaneously trigger a special sequence. The following lines indicate example probabilities, from the Class III simulations, of each possible main sequence award that a player can win while simultaneously triggering a special sequence.

```
1. <Feature Id="2" GroupId="2" Name="Bonus">
2. <Triggers award= "0, 5, 10, 15, 120, 200, 1010"
3. Probability= "19782, 5353, 1840, 477, 824, 347, 156" />
```

The above Lines 1-3 give the game-engine enough information to determine how much an award (in credits) that the main sequence should provide. "Feature ID=2 GroupID=2 Name=Bonus" denotes that Feature ID "2" is used for a special sequence, and the following trigger award will be the obtainable award for the main sequence that triggers the special sequence. Line "2" lists the main sequence awards, in credits, that the special sequence is allowed to win, and in Line "3," the Probability list shows the probabilities that each of the main sequence awards above will likely be used. For the first set of award and probability, Award=0, and Probability=19782. This means that when the game-engine decides to enter a special sequence, the chance for the player to win the award of "0" in the main sequence before triggering the special sequence is 19782 out of 19782+5353+1840+477+824+347+156=28779, which is 19782/28779=68.74%.

A new set of tickets, "sequence tickets," may be introduced to record all the spin results for a free spin or all the picked values in a bonus game. All the outcomes, picked values, and spins may result in every special sequence that are obtained during the Class III simulation. There may be several kinds of sequence ticket files, depending on the rules of the particular Class III game being simulated, including:

1. Base game ticket;
2. Jackpot ticket;
3. bigger ticket;
4. Bonus game ticket;
5. Free spin sequence ticket; and
6. Free spin ticket.

These are described as follows examples.

1. Base Game Ticket a. 0 0 S 25 7 6 20 18 b. 105 2 S 15 2 4 6 21 c. 555 10 S 6 2 22 14 2 M

Base game tickets may be used to represent the 5 reel stops in a 5×3 slot machine game. Lines "a," "b," and "c" are three instance of a base game ticket. In Line "a," the first number "0" represents the award in credits, the second number "0" represents the number of lines that create this winning award (0 lines) the $3^{rd}$ symbol "S" has no special meaning, and the $4^{th}$ number to the $9^{th}$ number represent the reel stop positions in the 5 reel strip of game symbols in a 5×3 game. Because the reel strip has been pre-define, the reel positions recorded in $4^{th}$ number to the $9^{th}$ number give all 15 symbols presented in a 5×3 slot game. Similarly, Line "b" represents a ticket that pays "105" credit that has 2 winning lines with "15," "2," "4," "6," and "21" as the reel stop positions for reels 1 to 5, Line "c" has an extra "M" at the end, indicating that this ticket can only be used when a player makes a "max bet" wager. In some Class III games, such as "Bugs to Riches," a jackpot or other special feature is triggered only when the player wagers a max bet. Tickets stored in the "Base game ticket" are used to represent the main sequence only.

2. Jackpot Ticket d. 590 10 S 6 2 21 6 17 J10 e. 1330 10 S 5 2 14 24 4 J11.

The Jackpot ticket file contains all the tickets that can trigger Jackpot, and has a similar structure as the Base Game ticket file. In line "d," the first number, "590," represents the total award, in credits, won in the main sequence (base game). The second number, "10," represents the number of winning lines that this game has. The "S" has no meaning. The $4^{th}$ to the $8^{th}$ numbers represent the 5 reel stop positions in the 5 reel strips. The last symbol, "J10," identifies a trigger for a jackpot identified as "10." Line "e" gives a main sequence award of "1330" with 10 winning fines and is a trigger for Jackpot with identification "11."

3. Trigger Ticket f. 10 1 S 12 4 20 8 5 T01 g. 10 2 S 26 24 5 12 13 T02

Trigger tickets are used if the game-engine decides that the player will go to a special sequence based on the performance table as defined in the XMLs. The Trigger ticket file contains all the tickets that can trigger special sequences. It has a similar structure as the Base game ticket. The first number, "10," in line "f" represents the total award, in credits, won in the base game, and the second number, "1," represents the number of winning lines that this game has. The $4^{th}$ to the $8^{th}$ numbers represent the 5 reel stop positions in the 5 reel strips. The last symbol, "T01," tells the game-engine that this is a trigger for a special game identified as "01." in the "Bugs to Riches" example, "01" would represent a bonus game. Line "g" gives a base game outcome of "10" with 2 winning lines and is a trigger for a special sequence identified as "02," which in "Bugs to Riches" would be a free spin.

4. Bonus Game Ticket h. 400 0 S 60 60 60 60 −2 0 60 60 100 100 60 60 −1 60

Line "h" is a bonus game ticket. The first number, "400," represents the award for this particular bonus game, the second number, "0," represents the main sequence award when this particular bonus game is triggered. This number should he tracked because in some games this particular bonus award is only obtainable with particular main sequence awards. But not all games require reading or using this number. If the bonus triggers in the main sequence have no effect on the bonus game itself, this number is not used by game-engine. The third symbol, "S," does not carry any meaning. The $4^{th}$ to the $17^{th}$ numbers are paired: the first number in each pair is the "picked icon" and the second is the award in credits associated with the previous picked icon. For example, the $4^{th}$ and the $5^{th}$ number from line "h" are a pair, where the first "60" is the "picked icon" and the second "60" is the "picked award value." The pair "−2" and "0" represent the scenario that the player picks an "advance" icon in a 5-level advance-able bonus game. Because there is no award for the "advance" icon, the next number in the pair, "0," represents just that. The last pair, "−1" and "60," represent the scenario where the player picked the "stop" icon in the same 5-level advance-able bonus game. The game gives an award of 60 credits to a player who selects the "stop" icon in the current level of the 5 available levels, and therefore the next number in the pairing is "60." Different numbers or symbols might be associated with different types of bonus games.

5. Free Spin Sequence Ticket i. 3230 10 S 0 20 105 215 310 215 300 210 370 1485 l. 3230 10 S 1 1 1 1 1 1 1 1 1 1 k. 3230 10 S 1 1 1 1 1 1 1 1 1 0

In one embodiment, when a Bingo award is provided by the server, the game-engine randomly generates a split of the award into free spins of different games. Sequence tickets eliminate this by recording all free spin outcomes during the Class III simulation. Lines "i," "j," and "k" represent but one outcome of a free spin sequence. The total winning award of this free spin sequence is the first number in line "i," 3230 credits. The second number is the award in credits from the base game when this free spin game is triggered. For some games, this number would not be needed if the base game award has no relation to how much award the free spin game will generate. The third symbol, "S," has no meaning. The $4^{th}$ number, "0," to the $13^{th}$ number, "1485," represent all 10 awards in the subsequent 10 spins. The first three numbers in line "j" are the same as in line "i," and the $4^{th}$ to the $13^{th}$ numbers represent the award multiplier associated with the current spin. The $4^{th}$ number in line "j" means that at the $1^{st}$ spin of the free spin game, the game-engine will multiply the slot-award by "1," and so on, for the remaining numbers. In line "k." the first three numbers are the same as in line "i." The $4^{th}$ to the $13^{th}$ numbers represent the remaining spins to give the player after the current game. Therefore, the $4^{th}$ number, "1," tells the game-engine that there is one more free spin remaining after this spin. The last number, "0," tells the game-engine that the $10^{th}$ spin is the last spin of the free spin game. The Free spin sequence file contains information to he used in play of Class II games having a regular free spin game where each spin is independent of the previous spins, where additional multipliers can be won, and where additional free spins can be won.

6. Free Spin Ticket 1. 880 10 S 2 2 4 6 16

Line "1" is a ticket from the Free spin ticket file. In the previous Free spin sequence ticket, all award sequences of the free spin were retained. When necessary to represent a certain award, the game-engine opens the Free spin ticket file to find tickets that can represent the slot machine award outcome. This Free spin ticket is needed when the main sequence and the free spin use different reel strips. In line "1," the first number, "880," represents the total award in credit that came from the base game when this free spin game was triggered. For some games, this number may not be needed if the base game awards have no relation to how much award the free spin game generates. The third symbol, "S," has no meaning. The remaining numbers represent the starting positions of the 5 initial reels. In the "Bugs to Riches" game, which is not a typical free spin game where each spin is independent of the previous spin sequence, the next spin in the free spin game is pre-determined and is always the same. Accordingly, only the initial 5 reel stops of the free spin reel strips may need to be recorded.

The Bingo server may send the game-engine an award in advance of an actual play. The game-engine may determine, based on the previous table of performance, whether to play a main sequence, a bonus game, or a free spin. For example, if the game-engine has decided to play a bonus game, specifically the "Pick Till Stop" game, the game-engine then looks up the performance table again to find out how much of the given Bingo award will be paid in the base game before entering the bonus game. Once this has been decided, the game-engine locates the Trigger ticket having the correct base game award and triggers to enter the bonus game. Then, when the player enters a bonus game during an actual play, the game-engine opens the Bonus game ticket file and searches for the game sequence that contains all the "Pick Value" before the game ends.

Table VII provides an example of a Bonus sequence ticket from the Class III game "Bugs to Riches." The player is not awarded a set number of picks, but rather picks objects—comprising numeric awards, advances to the next set of objects, stoppers, and an "all" in the final set—until finding a stopper or the "all."

TABLE VII

| Set 1 | Set 2 | Set 3 | Set 4 | Set 5 |
|---|---|---|---|---|
| 40 | 60 | 80 | 100 | 125 |
| 40 | 60 | 80 | 100 | 125 |
| 40 | 60 | 80 | 100 | 125 |
| 40 | 60 | 80 | 100 | 125 |
| 40 | 60 | 100 | 125 | 150 |
| 60 | 80 | 100 | 125 | 150 |
| 60 | 80 | 100 | 125 | 150 |
| 60 | 80 | 100 | 125 | 150 |
| 60 | 80 | 120 | 150 | 200 |
| 80 | 100 | 120 | 150 | 200 |
| 80 | 100 | 150 | 200 | 250 |
| 80 | 100 | 150 | 200 | 250 |
| Advance Stop + 40 | Advance Stop + 60 | Advance Stop + 80 | Advance Stop + 100 | All Stop + 125 |

"Advance" immediately warps the player to the next set of objects. "Stop" immediately ends the bonus game, "All" awards all unpicked numeric (non Stop) values within Set 5 of Table VII. Following is the Bonus sequence ticket file, in which the five lines represent five different outcomes of the bonus game in "Bugs to Riches":

The use of "tickets," etc, may not be a term of the art for Class II or Class III and is a holdover from the sweepstakes usage. The game-engine could display the bonus picks amount as well as all the steps till the completion of the Bonus game as it had occurred in a Class III setting. The following provides several examples regarding specific embodiments.

1. 400 0 S 60 60 60 60 −2 0 60 60 100 100 60 60 −1 60
2. 40 0 S −1 40
3. 360 0 S 40 40 40 40 60 60 −2 0 60 60 100 100 −1 60
4. 240 0 S 40 40 80 80 −2 0 60 60 −1 60
5. 100 5 S 60 60 −1 40

In line 1, the numbers, in order, have the following meanings:

400 is the sum of the awards given by subsequent numbers in line 1—in other words, the total bonus award.

0 and S [no meaning].

60 represents a pick.

60 represents an award.

60 represents a pick.
60 represents an award.
−2 represents an advance
0 represents an award.
60 represents a pick.
60 represents an award.
100 represents a pick.
100 represents an award.
60 represents a pick.
60 represents an award.
−1 represents a stop.
60 represents an award.

Using these sequence files causes special sequences (bonus games and free spins) in the Class II game to appear to the player just as they would in a Class III game. Having the Bingo outcome matching the Class III game outcome in terms of "contribution for different award intervals," the player gets the feel of the Class III game in a Class II Bingo setting. Updating the performance table and introducing sequence tiles causes the Class II game to match the performance of the special sequences (here, "Bugs" bonus games and free spins bonus game) of the Class III game almost entirely.

The functionality of the different components of different embodiments may be implemented in whole or in part with one or more Application Specific Integrated Circuits (ASICs) adapted to perform some or all of the applicable functions in hardware. Alternatively, the functions may be performed by one or more other processing units (or cores), on one or more integrated circuits. In other embodiments, other types of integrated circuits may be used (e.g., Structured/Platform ASICs, Field Programmable Gate Arrays (FPGAs), and other Semi-Custom ICs), which may be programmed in any manner known in the art. The functions of each unit may also be implemented, in whole or in part, with instructions embodied in a memory, formatted to be executed by one or more general or application-specific processors.

Figure 6:
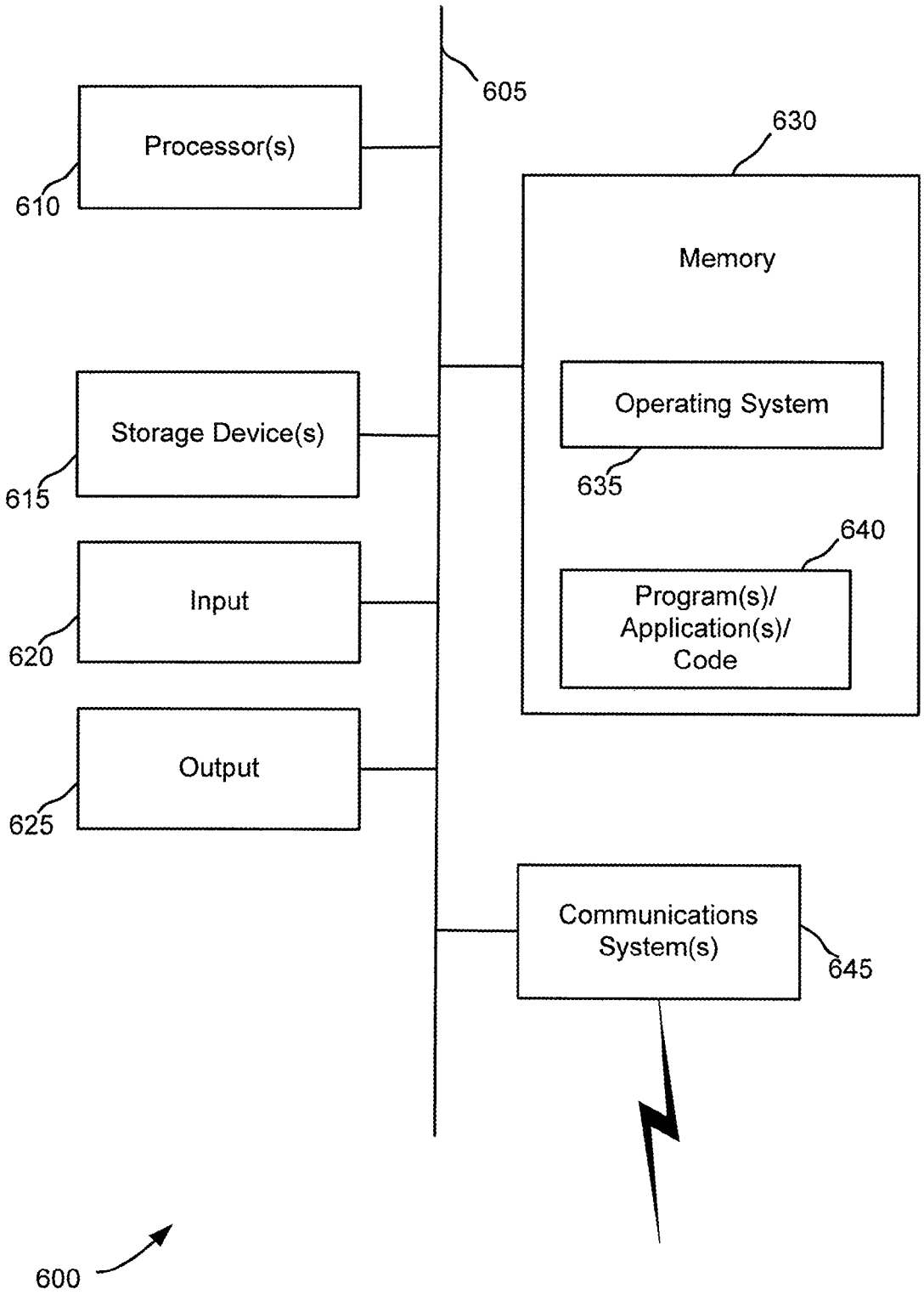
FIG. 6 is a computer system in accordance with various embodiments.

A computer system 600 that may be used utilizes different methods for adapting a Class II game to provide play characteristics of a Class III game is illustrated with the schematic diagram of FIG. 6. This drawing broadly illustrates how individual system elements may be implemented, whether in a separated or more integrated manner. The exemplary structure shown is comprised of hardware elements that are electrically coupled via bus 605, including processor(s) 610 (which may further comprise a DSP or special-purpose processor), storage device(s) 615, input device(s) 620, and output device(s) 625. The storage device(s) 615 may be a machine-readable storage media reader connected to any machine-readable storage medium, the combination comprehensively representing remote, local, fixed, or removable storage devices or storage media for temporarily or more permanently containing computer-readable information. The communications system(s) interface 645 may interface to a wired, wireless, or other type of interfacing connection that permits data to be exchanged with other devices. The communications system(s) 645 may permit data to be exchanged with a network.

The system 600 may also include additional software elements, shown as being currently located within working memory 630, including an operating system 635 and other code 640, such as programs or applications designed to implement methods of the invention. It will be apparent to those skilled in the art that substantial variations may be used in accordance with specific requirements. For example, customized hardware might also be used, or particular elements might be implemented in hardware, software (including portable software, such as applets), or both.

It should be noted that the methods, systems and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the invention.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Moreover, as disclosed herein, the term "memory" or "memory unit" may represent one or more devices for storing data, including read-only memory (ROM), random access memory (RAM), magnetic RAM, core memory, magnetic disk storage mediums, optical storage mediums, flash memory devices or other computer-readable mediums for storing information. The term "computer-readable medium" includes, but is not limited to, portable or fixed storage devices, optical storage devices, wireless channels, a sim card, other smart cards, and various other mediums capable of storing, containing or carrying instructions or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a computer-readable medium such as a storage medium. Processors may perform the necessary tasks.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over, or otherwise modify, the application of the invention. Also, a number of steps may be undertaken before, during, or after the above elements are considered. Accordingly, the above description should not be taken as limiting the scope of the invention. The invention may be practiced in other ways than the exemplary embodiments described and illustrated.

The invention claimed is:

1. A method of adapting a Class II game, the method comprising:

determining a first Class III frequency of occurrence of a first Class III award based on a plurality of simulations of the Class III game;

obtaining a first Class II frequency of occurrence of a first Class II event in a Class II game; and determining if the first Class III frequency of occurrence is similar to the first Class II frequency of occurrence, and if so:

assigning a first award for the first Class II event based upon the first Class III award, and re-assigning a second award to the first Class II event based on seeking alignment of contribution of awards in the Class II game with the Class III game;

wherein re-assigning the second award to the first Class II event is based on a comparison of a Class III award contribution and a Class II award contribution resulting from at least another simulation of the Class II game; and upon occurrence of the first Class II event, displaying at least one of the first and second awards in a slot machine.

* * * * *

UNITED STATES PATENT AND TRADEMARK OFFICE

CERTIFICATE OF CORRECTION

PATENT NO. : 9,275,521 B2
APPLICATION NO. : 13/860145
DATED : March 1, 2016
INVENTOR(S) : Chang et al.

It is certified that error appears in the above-identified patent and that said Letters Patent is hereby corrected as shown below:

In the Specification

Column 1, line 63, delete "live" and insert --five--

Column 4, line 67, insert --with-- before various

Column 6, line 1, insert --in-- before FIG.

Column 6, line 39, insert --II-- after Table

Column 7, line 17, delete "he" and insert --be--

Column 7, line 27, insert --a-- before cover-all.

Column 11, line 62, delete "he" and insert --be--

Column 14, line 66, delete "he" and insert --be--

Column 15, line 50 delete "he" and insert --be--

Column 17, line 20, delete "tiles" and insert --files--

Signed and Sealed this
Nineteenth Day of July, 2016

Michelle K. Lee

Michelle K. Lee
*Director of the United States Patent and Trademark Office*